US008936660B2

(12) United States Patent
Cruz Aguado

(10) Patent No.: US 8,936,660 B2
(45) Date of Patent: Jan. 20, 2015

(54) VENTILATION SCREEN

(71) Applicant: Jorge Andres Cruz Aguado, London (CA)

(72) Inventor: Jorge Andres Cruz Aguado, London (CA)

( * ) Notice: Subject to any disclaimer, the term of this patent is extended or adjusted under 35 U.S.C. 154(b) by 15 days.

(21) Appl. No.: 13/906,382

(22) Filed: May 31, 2013

(65) Prior Publication Data

US 2013/0319242 A1 Dec. 5, 2013

Related U.S. Application Data

(60) Provisional application No. 61/654,921, filed on Jun. 3, 2012.

(51) Int. Cl.

| | |
|---|---|
| ***F24F 7/02*** | (2006.01) |
| ***F24F 7/00*** | (2006.01) |
| ***F24F 13/08*** | (2006.01) |

(52) U.S. Cl.

CPC ..... *F24F 7/00* (2013.01); *F24F 13/082* (2013.01); *F24F 2221/52* (2013.01)

USPC ..... 55/385.4; 55/418; 55/413; 454/196; 454/237; 454/254; 454/339; 454/367

(58) Field of Classification Search

USPC ..... 55/385.1, 385.4; 95/268; 454/365, 366, 454/367, 339, 341, 356, 368; 52/57, 199; 210/155

See application file for complete search history.

(56) References Cited

U.S. PATENT DOCUMENTS

| | | | | |
|---|---|---|---|---|
| 1,914,728 | A | | 6/1933 | Plym |
| 2,120,730 | A | | 6/1938 | Chemoski |
| 2,376,230 | A | | 5/1945 | Coifed |
| 3,991,533 | A | | 11/1976 | Nagase |
| 4,452,024 | A | | 6/1984 | Sterriker et al. |
| 4,572,266 | A | * | 2/1986 | Beckerer et al. ..... 160/92 |
| 4,899,646 | A | | 2/1990 | Maras |
| 4,949,514 | A | * | 8/1990 | Weller ..... 52/12 |
| 5,112,278 | A | | 5/1992 | Roberts |
| 5,297,373 | A | | 3/1994 | Olsen |
| 5,542,224 | A | | 8/1996 | Olsen |
| 5,549,513 | A | * | 8/1996 | Thomas et al. ..... 454/365 |
| 5,601,485 | A | | 2/1997 | Gigola |
| 5,617,780 | A | | 4/1997 | Robbs |
| 5,664,375 | A | | 9/1997 | Ward |
| 5,678,360 | A | * | 10/1997 | Fort et al. ..... 52/14 |
| 5,782,051 | A | | 7/1998 | LaVoie |
| 5,839,244 | A | | 11/1998 | Johnson et al. |
| 6,123,751 | A | * | 9/2000 | Nelson et al. ..... 95/268 |
| 6,217,099 | B1 | | 4/2001 | McKinney et al. |
| 6,286,273 | B1 | | 9/2001 | Villela et al. |
| 6,368,386 | B1 | * | 4/2002 | Nelson et al. ..... 95/268 |
| 6,439,991 | B1 | | 8/2002 | Jarnot |
| 6,923,250 | B2 | | 8/2005 | Hegg et al. |

(Continued)

*Primary Examiner* — Duane Smith

*Assistant Examiner* — Minh-Chau Pham

(57) ABSTRACT

A wall ventilation screen to be used in exterior walls of buildings or vehicles for protecting against rain water and other elements while simultaneously enabling air flow. The screen includes a plurality of air passages that enable air flow from one side of the screen to the other but preferably without linear communication between both sides through the air passages. The air passages present an upwardly traveling trajectory from an exterior or exposed space to a protected space, preferably with lateral changes of direction as well. Therefore rain water that comes directly from precipitation or splashing from an adjacent surface cannot reach a protected space. The geometry of the air passages provides protection against other environmental or man made elements.

18 Claims, 7 Drawing Sheets

(56) References Cited

U.S. PATENT DOCUMENTS

| | | | | |
|---|---|---|---|---|
| 7,165,596 | B1 | 1/2007 | Helton | |
| 7,624,783 | B2 | 12/2009 | Sensenig | |
| 7,625,275 | B1 | 12/2009 | Hoke et al. | |
| 7,670,217 | B1 | 3/2010 | Brodeur | |
| 7,774,999 | B2 | 8/2010 | McKee | |
| 7,780,510 | B2 | 8/2010 | Polston | |
| 8,069,621 | B2 | 12/2011 | Mantyla et al. | |
| 2007/0275652 | A1 | 11/2007 | Berkompas | |
| 2009/0236273 | A1* | 9/2009 | Esmond et al. | 210/155 |
| 2012/0015596 | A1 | 1/2012 | Fang | |
| 2012/0055525 | A1 | 3/2012 | Choi | |

* cited by examiner

VENTILATION SCREEN

BACKGROUND OF THE INVENTION

This invention is in the field of ventilation. More particularly, the invention relates to a wall ventilation screen that permits airflow but simultaneously prevents rain water other elements from penetrating into buildings or vehicles.

There are numerous circumstances when it is desirable to keep a flow of fresh air while protecting the interior of a building, vehicle, canopy, tent, shelter (equipment, plants, animals or human shelter), or personal enclosure from rain and other adverse natural or man-made elements including noise, light, or sand.

There are two important characteristics that define a ventilation device performance. The first is permitting an adequate air flow. The second is protecting against rain water, sand, noise and other elements. The establishment of an adequate air flow depends among other factors on the proportion of area that is not constricted by the devices' structures and their shapes, usually called "free area". Those skilled in the art know that the air flow capacity of louvers or other ventilation devices is measured by the air pressure drop across the device. It is obvious for those skilled in the art that a design consideration should include minimizing this pressure drop.

The most commonly used devices for building ventilation are louver or damper vents. A louver is a window blind or shutter with parallel and generally horizontal slats. In louvers, the slats typically have a fixed angle in relation to air flow. Dampers consist of a movable plate, valve or parallel slats that regulate the air flow. Water-proof or storm-proof louvers provide some protection against rain water under weather conditions with little or no wind. However, when air velocity is above 5 m/s (1000 fpm), currently known louvers tend to allow significant water penetration. In louvers the protection against other environmental elements is also limited.

Dampers present structures for the regulation of air flow, and assist in preventing rain water from penetrating under storm conditions. However, structures with dampers are relatively expensive and need human intervention or expensive sensor-activated mechanisms to close and open the slats or regulate the air flow.

In general, such previous ventilation devices suffer from lack of efficiency in preventing the penetration of wind-driven rain water, or from high cost.

Another approach to protecting enclosures from rain water and simultaneously allowing some air permeability is based on panels of material made from porous membranes. For example, air-permeable membranes exist for use as rain screens in building walls and roofs. These materials certainly provide protection from rain water to internal building structures, but the air circulation through those membranes is generally insufficient to provide fresh air to spaces occupied by persons, animals or plants. Additionally, those membranes are not resistant enough to be exposed to the external weather for long time.

SUMMARY OF THE INVENTION

In view of the preceding, it is an object of the invention to provide an efficient and inexpensive wall ventilation screen. The invention comprises a vertical screen to be used in the exterior walls of buildings or vehicles. The screen includes air passages with a location and geometry such that air can flow freely between both sides of the screen, but rain water or other natural or artificial elements generally are unable to invade a protected space through the air passages under normal conditions and perhaps under all but the most extreme conditions. The expression "air passages" as used herein means ducts, passages, channels, tunnels or the like to enable air flow. Free air and water vapor circulation through the air passages in both good and bad weather conditions permit reduction of humidity and thereby discourage generation of mold or other forms of damage occasioned by wet or overly humid surfaces.

The invention provides a wall ventilation screen that includes a plurality of air passages with a predetermined shape, such that there is substantially no direct linear communication through the air passages between one side of the screen and the other. In addition, the air passages present a generally upwardly traveling trajectory from the exposed side of the screen towards the protected space.

The shape and orientation of the air passages generally prevents rain water from invading the protected space even if water enters the air passages with strong wind, except perhaps under the most extreme conditions. The shape of the air passages causes rain drops to contact the wall of the air passages, lose kinetic energy and drain by gravity before reaching the protected space under all or almost all conditions. The intensity of other environmental elements like light, wind and sound is also considerably reduced by the screen of the invention. Air and water vapor can flow freely from one side of the screen to the other.

The expression "protected space" as used herein means a space that is desired to be protected against rain water and other environmental elements including noise, light, sand, or man-made elements. Without limitation, the protected space may include the interior of buildings, houses, tents, equipment enclosures, animal shelters, motor vehicles, marine vessels, means of transportation of people, animals, plants or materials, green houses, plant enclosures, beehives, tunnels, composters, garbage bins, etc. The expression "exposed space" as used herein means the space outside the protected space, i.e. the space where precipitation, or environmental or man-made elements may be present.

Despite thousands of years of construction experience, avoiding rain infiltration and building damage is still one of the most difficult engineering tasks we face. The screen of the invention attempts to provide a holistic solution to this problem by addressing the three main challenges of rain protection: deflection, drainage and drying.

In the invention, deflection of rain water is achieved by the surface of the screen facing the exposed space, i.e. the external side. This side preferably has a smooth hydrophobic surface that repels water. Air passages through the screen have downwardly-oriented openings facing the external side, so as a result water does not get trapped in the air passages and runs down by gravity. Additionally, there is substantially no linear communication between one side of the screen and the opposite side through the air passages. Therefore, rain water driven by wind inevitably hits walls of the air passages, loses kinetic energy, and drains down by gravity towards the exposed space.

The drainage of rain water is accomplished by the geometry and orientation of the air passages. The air passages have downwardly oriented surfaces from the protected space towards the exposed space. There are no shapes like "J" or "V" that interfere with the drainage of water. Therefore water that invades the interior of the air passages drains by gravity towards the exposed space. Preferably, the drainage is facilitated as well by selecting a hydrophobic material for the ventilation screen. Furthermore, the cross-sectional area of the air passages is made large enough to prevent capillary action from producing any upward movement of water. All these characteristics tend to efficiently prevent the penetration of water through the air passages into the protected space.

The lack of linear connection, or substantial lack of linear connection, between both sides of the screen through the air passages is important. By non-linear communication, it is meant that there is no path through the air passages that follows a straight line. However, it should be understood that very small gaps are not excluded from the scope of the invention, i.e. in some embodiments or implementations it may be possible to trace a straight line such that light or air could penetrate at a specific angle, like looking through a very narrow slit. However, it is preferable that even such small gaps or slits be avoided, especially where privacy is or may be a concern.

Lack of linearity reduces the likelihood of wind-driven water drops reaching the protected space. Additionally, the lack of linear connection provides protection against other elements including, but not limited to, noise, light, and wind-driven sand. A further additional benefit of this geometry is that the screen provides a sight-proof barrier that prevents vision through the screen and offers security at installations prone to vandalism.

Consequently the objects and advantages of preferred embodiments of the invention include some or all of the following:

a. To provide a wall ventilation screen that has multiple uses such as:
   i. Protection against wind-driven rain water.
   ii. Reduction of external noise.
   iii. Reduction of light penetration.
   iv. Provision of privacy.
   v. Protection against vandalism.
   vi. Manufacture of gable vents, trickle vents, and devices protecting air inlets or outlets and ventilation ducts.
b. To provide a wall ventilation screen that can be built at low cost,
c. To provide a durable wall ventilation screen.
d. To provide a wall ventilation screen with a smooth surface that repels water efficiently and does not accumulate dirt.
e. To provide a wall ventilation screen that is compact, light in weight, rigid and in some cases flexible, foldable and portable.
f. To provide a wall ventilation screen that can be used in combination with other accessories, such as window insect screens, bird screens, or anti-theft devices for example.
g. To provide a wall ventilation screen that can be used in combination with a powered ventilation system, such as a fan, bladeless fan, blower, air conditioner, or ventilator.
h. To provide a wall ventilation screen that can be cleaned easily with pressurized water, soap, detergent or other common means.
i. To provide a will ventilation screen that provides abundant air flow with little or no draft.
j. To provide a wall ventilation screen that can provide ventilation in transportation vehicles, and depending on how the screen is used, that can drive air in or out, or prevent excessive drafts when the vehicle is in motion.
k. To provide a wall ventilation screen that can be made of diverse materials, including but not limited to plastics, recyclable plastics, rubbers, metals, fabric, concrete, noise dampening materials, impact-proof materials or combinations thereof.
l. To provide a wall ventilation screen which is relatively maintenance-free.

Notwithstanding the preceding, it should be understood that not all embodiments of the invention as defined in the accompanying claims, including preferred embodiments, will necessarily achieve all of the above objects and advantages. The preceding is intended as a list of advantages and potential advantages of the invention, without a promise that all will be achieved in all embodiments of the invention as defined in the accompanying claims.

Still further objects and advantages may become apparent from a consideration of the following description and/or the accompanying drawings.

BRIEF DESCRIPTION OF THE DRAWINGS

In the accompanying drawings of examples of the invention.

DETAILED DESCRIPTION

Reference will now be made in detail to embodiments of the invention, as examples only, with reference to the accompanying drawings.

Preferred Embodiment

FIGS. 1, 2A, 2B and 3

Figure 1:
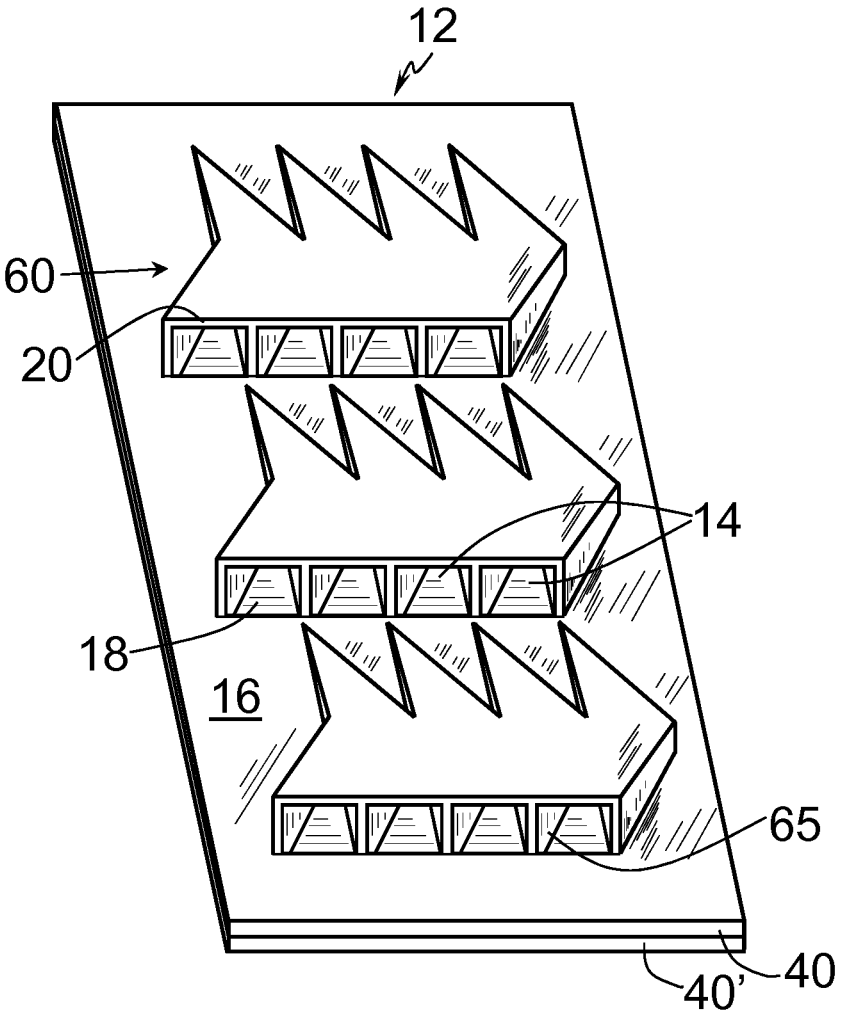
FIG. 1 is a perspective view of the exposed side of an exemplary screen according to the invention, as viewed looking slightly upwardly so that the openings are visible.

FIG. 1 shows a preferred embodiment of a wall ventilation screen 12 viewed from the front thereof, as an example of the invention. Screen 12 is substantially vertical. No frame for the screen is shown, but it should be clearly understood that the screen can be mounted in virtually any form of frame or support imaginable, to suit the particular type and location of installation, or depending on the materials used, the screen could be self-supporting. Preferably, the screen is installed in exterior walls of buildings or vehicles. The screen has a plurality of air passages 14. FIG. 1 illustrates a screen with twelve air passages 14. However, the number of air passages can be much higher. There is no limit on the size and number of air passages. Air passages are separated by walls 65. Preferably, air pessaries 14 present a combined free venting area that is at least 10% of the area of the screen. The free venting area is defined as the minimum cross-sectional area that is open to air flow.

The screen 12, shown in FIG. 1, is assembled from two panels 40 and 40'. In this embodiment, the panels are identical. To form the screen, the panels are stacked and engaged to each other back to back in such a way that one is inverted in relation to the other. The panels are fabricated with structures defined in this particular embodiment as air passage assemblies 60. The air passage assemblies contain internal dividing walls 65 and openings 20 and 20'. As will be shown later in describing other embodiments, the air passage assemblies of this configuration are only one of many possible structures. The air passage assemblies have a shape and location on panels 40 and 40' such that when the panels engage with each other, the air passage assemblies of the two panels collaboratively form the air passages 14. The shape of the air passages is predetermined by the shape of the air passage assemblies 60.

Figure 2A:
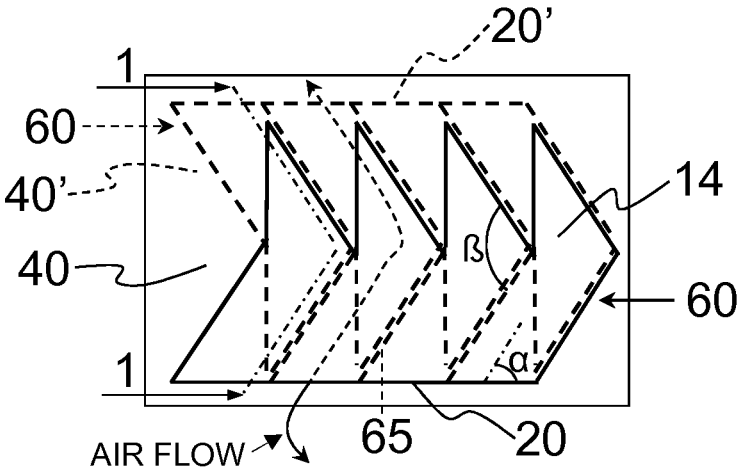
FIG. 2A is a schematic front view of part of the screen of FIG. 1, showing an air passage assembly of four air passages, as viewed from the exposed space.
Figure 2B:
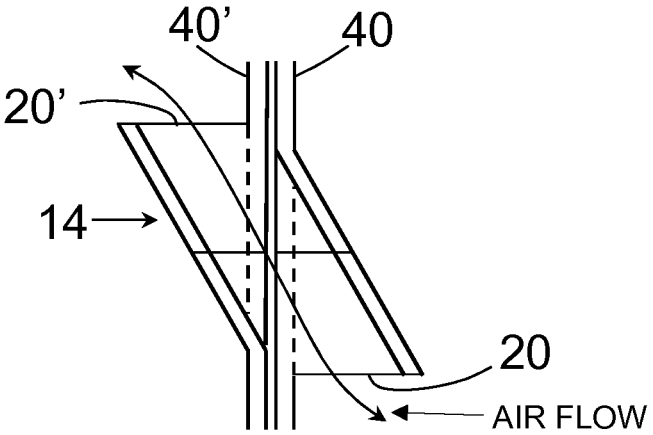
FIG. 2B is a cross-sectional side view of part of the screen of FIG. 1, corresponding to FIG. 2A, as viewed from lines 1-1 in FIG. 2A.
Figure 3:
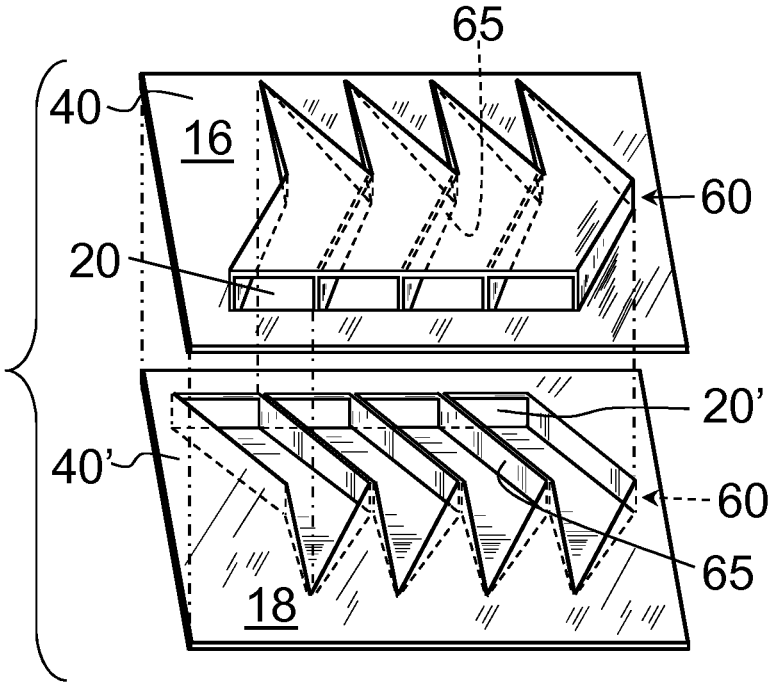
FIG. 3 is an exploded view of one air passage assembly of the screen of FIG. 1.

FIGS. 2A, 2B and 3 show further specific details of one air passage assembly 60 of screen 12. As seen best in FIG. 3, panels 40 and 40' are inverted in relation to each other, such that when a first opening 20 on panel 40 is facing down, a second opening 20' on panel 40' is facing up, or vice versa. Openings 20 and 20' preferably are substantially horizontal (as illustrated in FIG. 2B). As shown in FIGS. 2A and 2B air passages 14 present an upwardly traveling trajectory from first opening 20 facing an exposed space to second opening 20' facing a protected space. The axis of the air passage relative to the plane of the first opening 20 is in a generally upward direction, and as shown in FIG. 2A, in this embodiment it is also at a lateral angle $\alpha$ of preferably at least 25 degrees in relation to a horizontal plane.

FIG. 2A shows that the shape of the air passages 14 is a ">" shape (or of course it could be a "<" shape) when seen from the front. This shape results in a non-linear path throughout the air passage. This means that the air passages are shaped such that a straight line generally cannot be traced through the air passage between one side of the screen and its opposite side, though as stated previously, inconsequential small gaps could be possible in some embodiments. FIG. 2B appears to show a straight line, but in fact it is only straight in a side view; it is in fact bent as seen from the front, i.e. as seen in FIG. 2A. As shown in FIG. 2A, air flow is channeled by the air passages 14 first upwardly and in one lateral direction until the mid point of the air passage and then further upwardly and in an opposite lateral direction after passing the mid point. That is, the non-linear path of air flow is characterized by deviations in two dimensions parallel to the plane of the screen, i.e. first in one lateral direction, and then in an opposite lateral direction. Simultaneously the air flow is directed from one side of the screen to a second side of the screen, this means in a dimension perpendicular to the plane of the screen as shown in FIG. 2B. However, it should be understood that there are many possible shapes that will result in a non-linear geometry. Therefore the ">" shape of this embodiment is provided only as example and it is not restrictive. The angle $\beta$ in FIG. 2A could range, for example, from 25 degrees (or possibly less, with loss of efficiency), up to 180 degrees (i.e. no lateral deflection). Also, it should be clear that the angling could apply to only a portion of the air passages, i.e. there could be a straight portion, vertical for example, before any angled portion. Or, in some embodiments, there may be no lateral angling or deflection at all, i.e. with angle $\beta$ being 180 degrees. Simultaneously the air flow is directed from one side of the screen to a second side of the screen. However, it should be understood that there are many possible shapes that will result in a non-linear geometry. Therefore the ">" shape of this embodiment is provided only as example and it is not restrictive. The angle $\beta$ in FIG. 2A could range, for example, from 25 degrees (or possibly less, with loss of efficiency), up to 180 degrees (i.e. no lateral deflection). Also, it should be clear that the angling could apply to only a portion of the air passages, i.e. there could be a straight portion, vertical for example, before any angled portion. Or, in some embodiments, there may be no lateral angling or deflection at all, i.e. with angle $\beta$ being 180 degrees.

The panels 40 and 40' of screen 12 have external surfaces 16 and internal surfaces 18. When panels 40 and 40' are engaged, the external surface 16 of panel 40 is facing exposed space and the external surface 16 of panel 40' is facing protected space. The internal surface 18 of panel 40 is facing the internal surface 18 of panel 40' when both panels are engaged. As shown in FIG. 1, internal surface 18 of panel 40' blocks part of air passage assembly 60 in panel 40 preventing linear communication throughout air passages 14.

Air passages 14 have a cross-sectional area large enough to enable free air flow between both sides of the screen. The cross-sectional area of the air passages is not less than 0.2 $cm^2$ (0.03 square inches). This is the minimum cross-sectional area that prevents capillary force to assist in the upward movement of water through a channel. The cross-sectional area of air passages 14 does not have an upper limit. The cross-sectional area of air passages 14 remains relatively constant along the air passage from first opening 20 to second opening 20' in the opposite panel. The proportion of cross-sectional area contributed by one particular panel decreases with the distance from opening 20 in that panel due to the slope of air passage assemblies 60. As the proportion of cross-sectional area of air passage 14 decreases in panel 40, it simultaneously increases in panel 40' and vice-versa. Therefore the total cross-sectional area of air passage 14 remains approximately constant along the air passage. The slope of air passage assemblies 60 contributes to maximize the air flow by forming an external aerodynamic shape and no obstructing opening 20 in the adjacent, air passage assembly 60.

Screen 12 can be built of materials or a mix of materials selected from the group consisting of:

- plastics,
- silicone rubbers;
- fluorosilicone rubbers;
- hexafluoropropylene-vinylidene fluoride-tetrafluoroethylene terpolymers;
- butyl rubbers;
- polyisobutene;
- synthetic polyisoprene rubber;
- styrene-butadiene rubbers;
- polyethylene;
- low density polyethylene (LDPE)
- polypropylene;
- polyvinyl chloride (PVC);
- nylon,
- polycarbonate;
- polystyrene;
- polyesters;
- polyethylene terephthalate;
- polyurethane;
- acrylonitrile;
- natural rubber;
- acrylate-butadiene rubber;
- cis-polybutadiene;
- chlorobutyl rubber;
- chlorinated polyethylene elastomers;
- polyalkylene oxide polymers;

ethylene vinyl acetate;
tetrafluoroethylene propylene copolymers; and
thermoplastic-copolyesters
metals including but not limited to aluminum, copper, brass, steel, iron or galvanized steel.
glass composites
fiber reinforced composites
acoustic foam composites
concrete
fabric Screen 12 shown in FIG. 1 can be built of a rigid and hydrophobic material like plastic. A hydrophobic material prevents the adsorption of water to inner surfaces of the air passages 14 and prevents the buildup of water inside the air passages. A hydrophobic material also prevents the ascent of water through the air passages by capillary force.

Alternatively, screen 12 can be built of a flexible and hydrophobic material like silicone rubber. The flexibility of silicone rubber provides the capacity of diversifying its use and adapting it better to windows, tents, etc. Silicone rubber can be easily cut so it can be adapted to objects of different sizes and shapes.

Still other materials like metals can be used to build screen 12. Metals provide strength and durability to the screen which is an advantage in applications such as ventilation for industrial buildings.

There are several ways in which the ventilation screen of the invention can be build. Panels 40 and 40' can be molded using conventional aluminum, ceramic, steel or other type of molds. Conventional methods for molding silicone rubber and plastics and casting metals are well known. Then panels 40 and 40' are stacked and engaged or secured to each other by any conventional means, including lamination, binding, clips, latches, fasteners, snapping devices, adhesives, screws, bolts, etc. The resulting screen comprises panels 40 and 40' parallel to the plane of the screen. The manufacture of the screen 12 is very cost effective as it does not require intensive labour and numerous components. The screen can be manufactured by molding two identical panels in automatic production line machines. The panels only need to be engaged and packaged for distribution.

Screen 12 can be built also as a monolithic piece of material using techniques well known in the art, and conventional methods of 3D printing including but not limited to stereolithography, selective laser sintering, fuse deposition modeling and others.

Operation (FIGS. 1, 2A, 2B and 3)

Air passages 14, shown in FIG. 1, enable the travel of air between the exposed space and the protected space via a non-linear trajectory. Air penetrates each air passage 14 through a first opening 20 and exits the air passage through a second opening 20' located in the same air passage 14 but on the opposite side of the screen. The direction of air movement is determined by the difference in atmospheric pressure between the protected and exposed spaces, the velocity of wind and other factors. To avoid the penetration of rain water, screen 12 is installed in such a way that openings 20, which are preferably horizontal, are facing down towards the exposed space. Therefore gravity counteracts the penetration of water or other elements like sand. In principle either of the two panels 40 or 40' can face the exposed space as long as openings 20 or 20' are facing down.

The lack of linearity and the upward orientation of air passages 14 prevent rain drops from traveling directly from the exposed space to the protected space. The non-linear shape of air passages 14 enables protection from water that comes directly from precipitation, from splashing from an adjacent surface or from wind-driven water coming in an oblique angle. Rain drops hit at least one time the air passage internal surface and lose kinetic energy before they can reach the protected space.

The combination of non-linearity and upward orientation of air passages 14 results in a wind-driven rain water protection that is greater than that of ventilation devices without the combination of these two characteristics. A similar rationale applies to sand, or other natural or artificial elements driven by air or by man-made devices. Light and sound also travel in a linear trajectory. Therefore the ventilation screen of this invention can be used as well as a sight-proof and noise dampening screen.

When screen 12 is used in the outside wall of a moving vehicle, air draft can be reduced by installing screen 12 in such a way that the orientation of openings 20 is away from the direction of air flow. The layout of screen 12 on the wall of the vehicle should be such that the >-shape of air passages 14 provides an aerodynamic contour. In this way the penetration of strong external current of air into the vehicle is reduced dramatically because for air to penetrate the interior of the vehicle it would have to flow against the direction of external air facing the moving vehicle. This geometry also contributes to prevent the penetration of water in the interior of the vehicle even if it is moving at high speed.

When screen 12 of the preferred embodiment is fabricated, its specific size and shape can be modified according to the environmental conditions where it will be used. For example, in temperate areas where snow is expected, openings 20 should be wider to prevent clogging of air passages 14 with snow. On the other hand, in regions with heavy rain fall and wind, openings 20 should be narrower to enhance the water protective capacity of the screen.

Depending on the specific use of the screen, several different features can be further included, added or attached to the screen. For example, a conventional frame (not shown) can be added to mount screen 12 in a window, a building opening, or a vehicle. Conventional methods for mounting windows, louvers, dampers and other ventilation devices can be used to mount screen 12 to a building wall, to a vehicle panel or to other structures. Those skilled in the art will recognize that it is obvious to include conventional means, such as caulking for example, to prevent the penetration of rain water through potential gaps between screen 12 and the structure where it is going to be mounted.

Screen 12 can include further a conventional insect screen or bird screen (not shown). Conventional insect and bird screens can be sandwiched between panels 40 and 40' (not shown). In difference to other passive ventilation devices, in this example of a ventilation screen, the insect and bird screens are protected against physical damage by panels 40 and 40'. This has added advantages, including: a) it increases significantly the durability of the insect or bird screen; b) it reduces cleaning and maintenance costs; c) it allows for thinner insect or bird screens, which benefits the air flow of the device and reduces cost; and d) it makes the installation or replacement of such insect or bird screens very easy. Moreover, when openings 20 are smaller than 4 $cm^2$ a bird screen is not necessary at all.

Screen 12 can also be used as a curtain in such a way that the lower part of the screen is hanging outside of the window and the top part is engaged to the top part of the window by diverse ways, like conventional suction cups, clips, magnets, Velcro®, nails, etc. Furthermore, screen 12 can be used in combination with a conventional powered ventilation system such as a fan, bladeless fan, air conditioning, or ventilators (not shown). Still further, panels 40 and 40' can sandwich conventional materials like porous membranes to provide enhanced protection against water, dirt and other elements.

A specific example of the invention follows. It should be understood that this example is for illustration only and that the invention is not limited to this example.

EXAMPLE

In one example of a wall ventilation screen built according to the preferred embodiment, the wall ventilation screen has a total area of 1052 $cm^2$ (1.1 square feet) including a frame. The width of the screen is 5 cm (2 inches). This example presents seven air passage assemblies of 15 air passages each. Each air passage has a cross-sectional venting area of 4 $cm^2$. This ventilation screen presents a total free venting area of 420 $cm^2$ (65 square inches). The free venting area is determined by the minimum cross-sectional area of the screen opened for air flow. The free venting area of the ventilation screen of this example accounts for 40% of the total area of the screen. In one example of an existing louver, rated as storm-proof, the free venting area is 29%.

The most commonly used criterion of air flow performance is the pressure drop. An air flow test was performed to compare the wall ventilation screen of this invention with the existing storm-proof louver under the same conditions. The air pressure drop of the wall ventilation screen of this invention was 35 Pa (0.14 in. w.g.) under a free air velocity of 5.08 m/s (18 Km/h or 1000 fpm). When the existing storm-proof louver was evaluated under the same conditions its pressure drop was 40 Pa (0.16 in. w.g.). Technical data from existing ventilation products confirms that most present similar or inferior air flow performance. Therefore, the distinctive structural chdraCteristics of the ventilation screen of this invention do not affect negatively the air flout in relation to conventional ventilation devices.

To test the capacity to protect against wind-driven rain water, the wall ventilation screen of this invention was subjected to simulated rain under a free air velocity of 8.3 m/s (30 Km/h or 1640 fpm). After 15 mins. of experimentation, no water at all (direct or splashed) was observed penetrating through the screen. When the storm-proof louver mentioned above was tested under the same conditions, there was significant amount of water penetrating the louver from the very first moment of the experiment. Thus, the combination of structural characteristics of the screen of this invention results in enhanced protection against wind-driven water.

Additional Embodiments (FIGS. 4-8)

Figure 4:
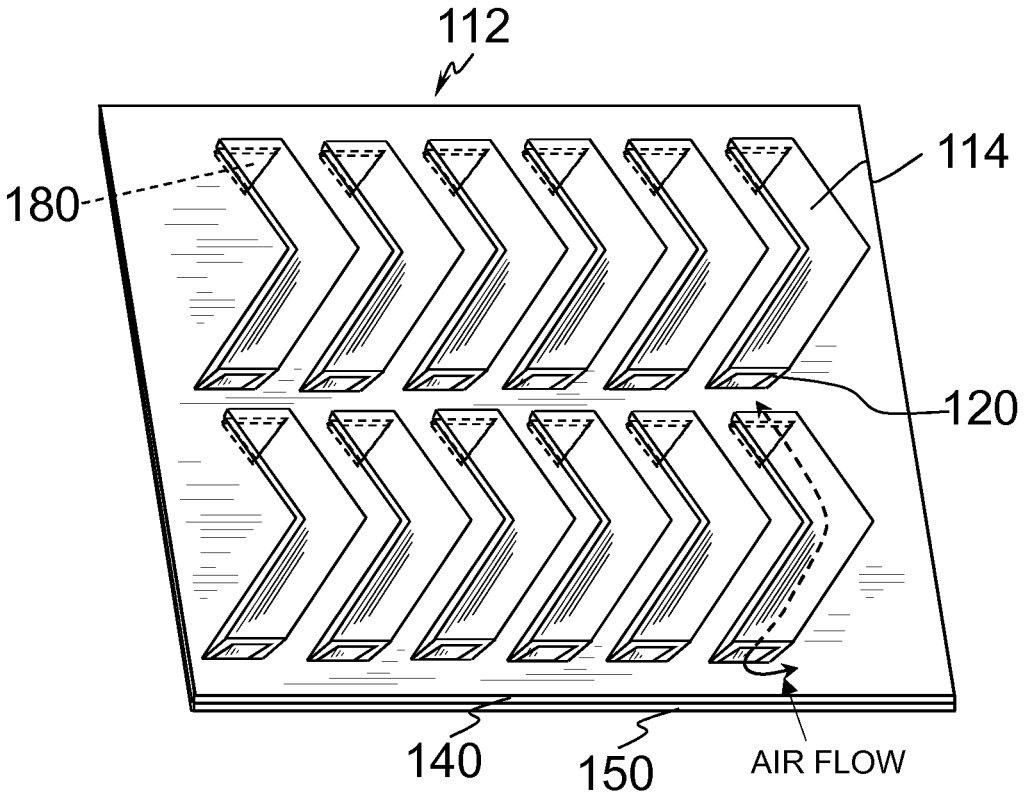
FIG. 4 is a perspective view of a second embodiment of the screen of the invention, as viewed from an exposed space, again looking slightly upwardly so that the openings are visible.

FIG. 4 shows a second embodiment of this invention, a wall ventilation screen 112, viewed from the front of the device. The screen has a plurality of air passages 114. Twelve are illustrated, but the number of air passages can be much higher. There is no limit to the number and size of air passages. The air passages have a predetermined shape. Each air passage has an opening 120 oriented to an exposed space and a hole 180 oriented to a protected space.

Figure 5:
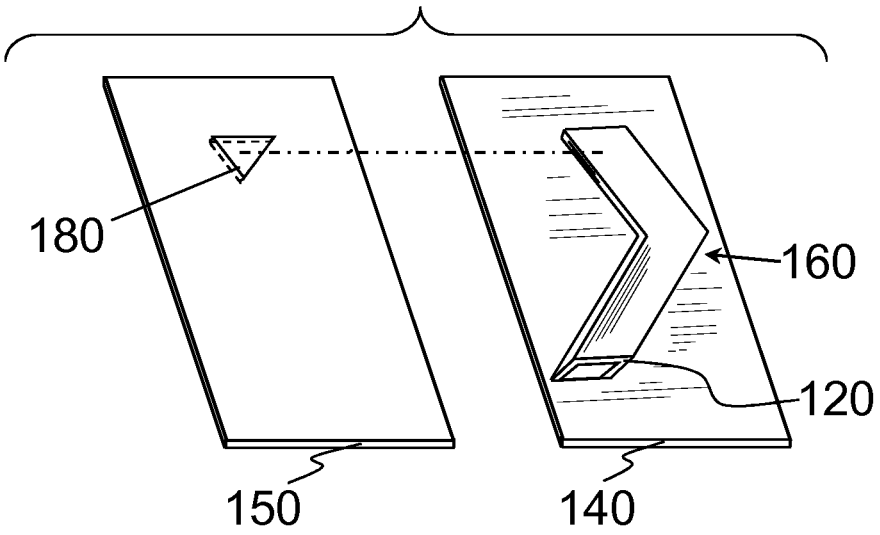
FIG. 5 is an exploded view of one air passage according to the embodiment shown in FIG. 4.

FIG. 5 shows further specific details of the screen of the second embodiment. The screen comprises panels 140 and 150. The panels contain complementary structures. Panel 140, facing an exposed space, is molded with structures defined here as chambers 160 shaped as a half-sleeve with an elbow ">". Chambers 160 contain openings 120 at one extreme of the chamber, at the bottom end of each chamber 160. The chambers become part of air passages 114 once panel 140 is engaged to panel 150. Panel 150 contains structures defined here as holes 180. Once both panels 140 and 150 are engaged together, holes 180 match only that area of chambers 160 which is opposite the spot where openings 120 are, in such a way that there is no linear communication between holes 180 and openings 120. Therefore, the resulting air passage does not have a linear path communicating the exposed space with the protected space. When screen 112 is in use, openings 120 face down on the side of the screen facing the exposed space, while holes 180 are on the side of screen 112 that is facing the protected space.

Air passages 114, shown in FIG. 4, permit the travel of air between an exposed space and a protected space through a non-linear trajectory. Therefore rain drops that come directly from the precipitation or from bouncing on an adjacent surface cannot travel directly from the exposed space to the protected space. The rain drops hit at least one time the air passage internal surface before they could reach protected space.

Additionally, air passages 114 are oriented in an upward traveling direction from air passage opening 120 to hole 180 facing the protected space. In such a way, when water drops hit the air passage inner surface they lose kinetic energy and drain by gravity towards openings 120 and the exposed space. When screen 112 is manufactured air passages 114 can be grouped together very closely or can be spaced depending on whether it is desirable to have more or less ventilation.

There are several ways in which screen 112 of the invention can be built. Panels 140 and 150 can be molded using aluminum, ceramic, steel or other materials. Methods for molding silicone rubber, plastics and metals are well known in the art. Then panels 140 and 150 are stacked and engaged (where engaged means also laminated, bound) into each other by using any suitable conventional means, including but not limited to clips, latches, fasteners adhesives, screws, bolts, etc. The resulting screen is parallel to the plane of the composing panels.

Screen 112 can be built also as a monolithic piece of material using well known in the art methods of 3D printing including but not limited to stereo-lithography, selective laser sintering, fuse deposition modeling and others.

The second embodiment of this invention has the advantage that it has a flat surface facing the protected area. Another benefit of this design is that it provides a superior surface for reception of labeling and print. Additionally, this flat surface offers an advantage when the ventilation screen of this invention is used with powered ventilation devices such as fans and ventilators, because holes 180 are perpendicular to the air flow and maximize air intake by air passages 114.

Figure 6:
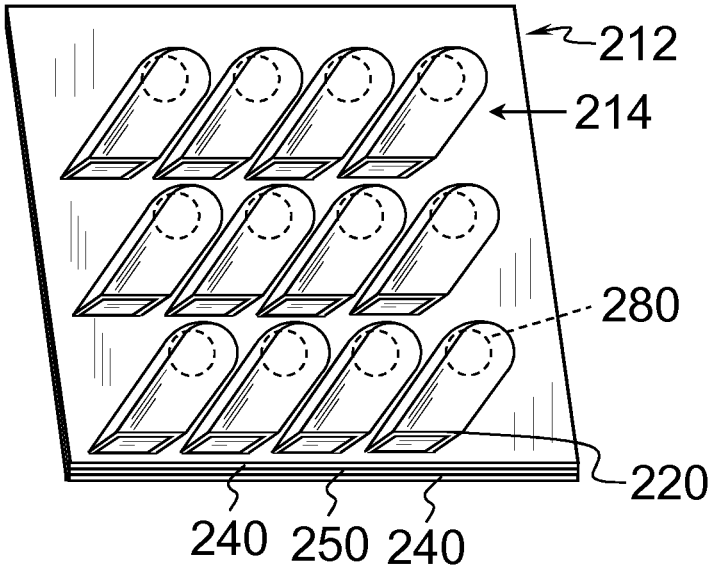
FIG. 6 is a perspective view of a third embodiment of the screen of the invention, as viewed from an exposed space, again looking slightly upwardly so that the openings are visible.
Figure 7:
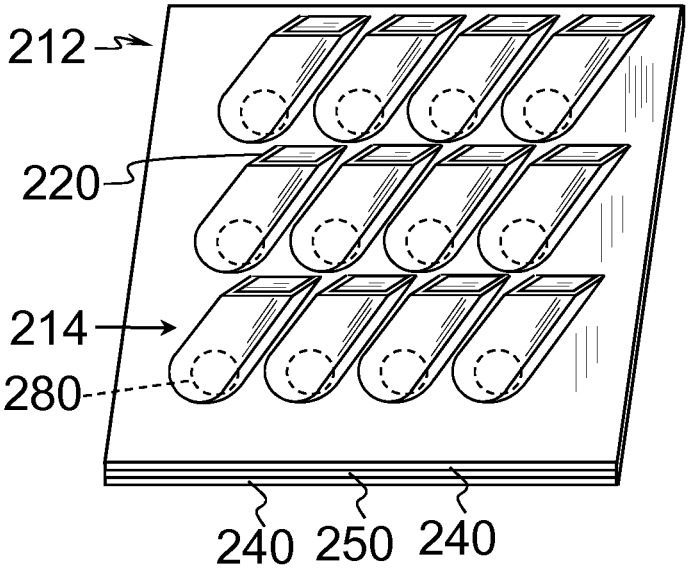
FIG. 7 is a perspective view of the third embodiment of the screen of this invention, as viewed from a protected space.
Figure 8:
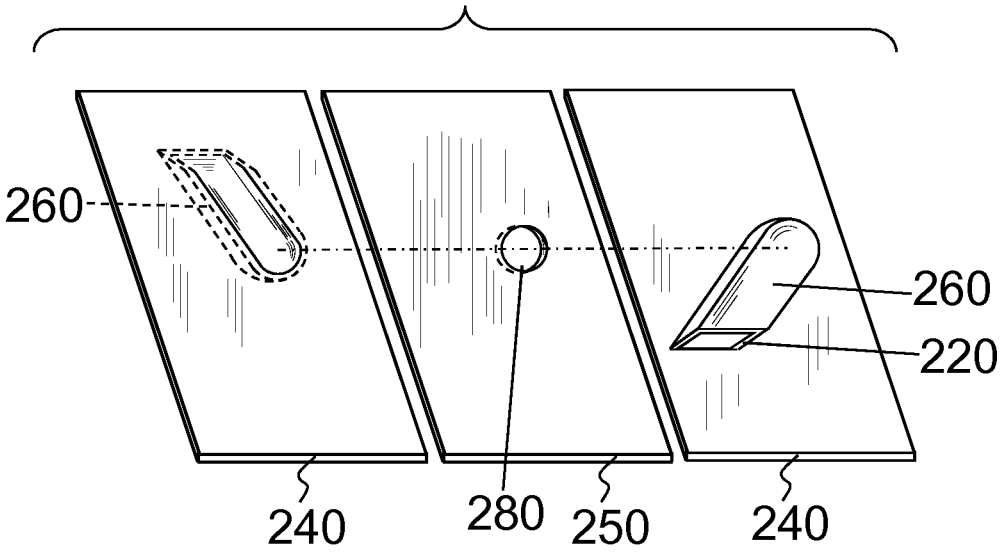
FIG. 8 is an exploded view of one air passage according to the embodiment shown in FIG. 6.

FIGS. 6-8 show a third embodiment of the invention, as another example. FIG. 6 shows wall ventilation screen 212 according to this embodiment, viewed from the front. As seen most clearly in FIG. 8, three panels are used to make the screen 212. All three panels contain complementary structures. Screen 212 comprises two outer panels 240 and one sandwiched panel 250. The two outer panels 240 are identical, but one is inverted in relation to the other. FIG. 6 shows a view of screen 212 taken from the exposed space. FIG. 7 shows a view of screen 212 when seen from the protected space. FIG. 8 shows an exploded view of part of screen 212 of this invention.

As shown in FIG. 8, outer panels 240 have structures defined here as slanted chambers 260 containing openings 220. Sandwiched panel 250 contains structures defined here as holes 280. Once all three panels are engaged, slanted chambers 260 in outer panels 240 are partially covered with panel 250 and become air passages 214. Holes 280 communicate slanted chambers 260 from one outer panel 240 with slanted chambers 260 in the second, identical but inverted, outer panel 240.

Air passages 214 are arranged in such a way that in the side facing the exposed space, opening 220 is facing down. In the side facing the protected space opening 220 is facing up. Air passages 214 are bent in such a way that there is no linear communication between both openings 220. Air passages 214 are bent preferably at an angle between 35° and 165°. Water drops penetrating through downward-facing opening 220 exposed to rain and other elements cannot travel linearly and up to the opposite upward-facing opening 220. On their way up water drops inevitably hit the inside walls of the air passages and drain by gravity.

There are several ways in which screen 212 of the invention can be built. Panels 240 and 250 can be molded using aluminum, ceramic, steel or other type of materials. Methods for molding silicone rubber, plastics and metals are well known in the art. Then panels 240 and 250 are stacked and engaged (where engaged means also laminated, bound) into each other by using conventional means including but not limited to clips, latches, fasteners, adhesives, screws, bolts, etc. The resulting screen is parallel to the plane of the composing panels. Panels 240 and 250 can be made of different materials, for example panels 240 can be made of metal and panel 250 of silicone rubber. In this combination panel 250 can work as a gasket to improve the water-protective properties of the screen.

Screen 212 can be built also as a monolithic piece of material using well known in the art methods of 3D printing, including but not limited to stereo-lithography, selective laser sintering, fuse deposition modeling and others.

The third embodiment of this invention has the advantage that air passages can be grouped closely to optimize area use. Additionally, chambers 260 on one outer panel 240 can spatially overlap chambers 260 in second outer panel 240 further optimizing space. Communication between chambers 260 is enabled through holes 280 in sandwiched panel 250. Panel 250 also prevents linear communication between one side and the other even when chambers 260 from opposite panels overlap. In this way the area of the screen can be optimized and the venting area can be increased. Additionally, depending on the material used for the manufacture of sandwiched panel 250, the screen can be made sound-proof, impact-proof or can incorporate other useful characteristics.

The principle of the wall ventilation screen described herein can be applied in screens, barriers, shields, films, covers of different construction and methods of manufacture, including for example, molding a monolithic piece of material. Additionally, a multitude of diverse designs can be developed under the same principle to fill the above mentioned utility goals. The screen of this invention is therefore not limited to the specific embodiments and examples provided above. All matter herein set forth or shown in the accompanying drawings is to be interpreted as illustrative and not in a limiting sense.

While the foregoing written description of the invention enables one of ordinary skill to make and use what is considered presently to be the best mode thereof, those of ordinary skill will understand and appreciate the existence of variations, combinations, and equivalents of the specific embodiments, methods, and examples herein. The invention should therefore not be limited by the above described embodiments, methods, and examples, but by all embodiments and methods within the scope and spirit of the invention as claimed.

The invention claimed is:

1. A wall ventilation screen for use in exterior walls of buildings or vehicles for protecting from rain and other elements while simultaneously enabling air flow;

said wall ventilation screen being substantially vertical;

said wall ventilation screen comprising a plurality of air passages through said screen from a first side of said screen, facing an exposed space, to a second side of said screen, facing a protected space;

said air passages having a first opening on said first side of said screen, facing substantially downwardly, and a second opening on said second side of said screen, above a horizontal plane through said first opening, said air passages being shaped such that there is substantially no straight-line path through said screen via said air passages.

2. A wall ventilation screen as in claim 1, wherein at least one portion of said air passages is angled laterally in a plane substantially parallel to the plane of the ventilation screen in at least one direction.

3. A wall ventilation screen as in claim 2, wherein at least one portion of said air passages is angled laterally in the plane of the ventilation screen first in one direction, and then in an opposite lateral direction.

4. A wall ventilation screen as in claim 2, wherein said lateral an are at least 25 degrees from horizontal.

5. A wall ventilation screen as in claim 1, wherein said air passages are angled from the plane of the screen at an angle of at least 25 degrees from a horizontal reference plane.

6. A wall ventilation screen as in claim 5, wherein said angle is in the: range of 40 to 70 degrees.

7. A wall ventilation screen as in claim 1, wherein said first openings are substantially horizontal and have a collective free venting area that is at least 10% of the area of the screen.

8. A wall ventilation screen as in claim 1, wherein said second openings face substantially upwardly and have a collective free venting area that is at least 10% of the area of the screen.

9. A wall ventilation screen as in claim 1, in combination with a conventional powered ventilation system, such as a fan or air conditioner.

10. A wall ventilation screen for use in exterior walls of buildings or vehicles for protecting from rain and other elements while simultaneously enabling air flow;

said wall ventilation screen being substantially vertical;

said wall ventilation screen comprising a plurality of air passages through said screen from a first side of said screen, facing an exposed space, to a second side of said screen, facing a protected space;

said air passages having a first opening on said first side of said screen, facing substantially downwardly, and a second opening on said second side of said screen, above a horizontal plane through said first opening;

wherein said screen is formed from at least two panels parallel to each other and the resulting screen, and engaged with each other, wherein said panels have complementary structures which collaboratively define said air passages when said panels are so engaged.

11. A wall ventilation screen as in claim 10, wherein said first openings are substantially horizontal and have a collective free venting area that is at least 10% of the area of the screen.

12. A wall ventilation screen as in claim 10, wherein said air passages are shaped such that there is substantially no straight-line path through said screen via said air passages.

13. A wall ventilation screen as in claim 10, wherein at least one portion of said air passages is angled laterally in a plane parallel to the plane of the ventilation screen in at least one direction.

14. A wall ventilation screen as in claim 13, wherein at least one portion of said air passages is angled laterally in the plane of the ventilation screen first in one direction, and then in an opposite lateral direction.

15. A wall ventilation screen as in claim 10, wherein said air passages are angled from the plane of the screen at an angle of at least 25 degrees from a horizontal reference plane.

16. A wall ventilation screen for use in exterior walls of buildings or vehicles for protecting from rain and other elements while simultaneously enabling air flow;

said wall ventilation screen being substantially vertical;

said wall ventilation screen comprising a plurality of air passages through said screen from a first side of said screen, facing an exposed space, to a second side of said screen, facing a protected space;

said air passages having a collective free venting area that is at least 10% of the area of said wall ventilation screen;

said air passages having a first opening on said first side of said screen, facing substantially downwardly, and a second opening on said, second side of said screen, substantially above a horizontal plane through said first opening;

said air passages being angled laterally in a plane substantially parallel to the plane of the wall ventilation screen in at least one direction.

17. A wall ventilation screen as in claim 16, wherein said air passages are shaped such that there is substantially no straight-line path through said screen via said air passages.

18. A wall ventilation screen as in claim 16, wherein said air passages are angled from the plane of the screen at an angle of at least 25 degrees from a horizontal reference plane.

* * * * *